US009644293B2

(12) United States Patent
Yuasa et al.

(10) Patent No.: US 9,644,293 B2
(45) Date of Patent: May 9, 2017

(54) KNITTED FABRIC AND GARMENT USING THE SAME

(75) Inventors: Masaru Yuasa, Kyoto (JP); Atsushi Toyama, Kumamoto (JP)

(73) Assignee: WACOAL Corp., Kyoto (JP)

( * ) Notice: Subject to any disclaimer, the term of this patent is extended or adjusted under 35 U.S.C. 154(b) by 805 days.

(21) Appl. No.: 14/007,998

(22) PCT Filed: Mar. 28, 2011

(86) PCT No.: PCT/JP2011/057623

§ 371 (c)(1),
(2), (4) Date: Sep. 27, 2013

(87) PCT Pub. No.: WO2012/131873

PCT Pub. Date: Oct. 4, 2012

(65) Prior Publication Data

US 2014/0017465 A1 Jan. 16, 2014

(51) Int. Cl.

| | |
|---|---|
| ***D04B 21/20*** | (2006.01) |
| ***A41D 13/00*** | (2006.01) |
| ***D04B 1/24*** | (2006.01) |

(52) U.S. Cl.

CPC ..... *D04B 21/207* (2013.01); *A41D 13/0015* (2013.01); *D04B 1/246* (2013.01);

(Continued)

(58) Field of Classification Search

CPC ..... D04B 1/246; D04B 1/207; D04B 1/24; D04B 7/24; D04B 7/30; D04B 9/26; D04B 9/42

See application file for complete search history.

(56) References Cited

U.S. PATENT DOCUMENTS 3,413,824 A * 12/1968 Kuney ..... D04B 13/00 66/105
5,590,548 A * 1/1997 Osborne ..... A41B 9/04 2/401

(Continued)

FOREIGN PATENT DOCUMENTS

CN 1382024 A 11/2002
CN 101438864 A 5/2009

(Continued)

OTHER PUBLICATIONS

Japan (JPO): Japanese Patent Application No. 2013-506897—Office Action—Issued Sep. 30, 2014.

(Continued)

*Primary Examiner* — Danny Worrell
(74) *Attorney, Agent, or Firm* — Morgan, Lewis & Bockius LLP

(57) ABSTRACT

A knitted fabric includes: a first knitted fabric region and a second knitted fabric region. The first region and the second region have different elongations from each other. The knitted fabric further includes buffer regions. The buffer regions are provided in at least one of the first region and the second region so as to be in contact with the first region and the second region. The buffer regions each have an elongation set so that, as the buffer region extends toward either one of the first region and the second region, the difference between the elongation of the buffer region and the elongation of the first region or the second region toward which the buffer region extends is reduced gradually. Between the first region and the second region, there is no boundary line that is substantially parallel to the course direction of the knitted fabric.

19 Claims, 7 Drawing Sheets

(52) U.S. Cl.
CPC ..... *A41B 2400/38* (2013.01); *A41B 2500/10* (2013.01); *D10B 2501/02* (2013.01); *Y10T 428/24942* (2015.01)

(56) References Cited

U.S. PATENT DOCUMENTS

| | | | | | |
|---|---|---|---|---|---|
| 5,787,732 | A * | 8/1998 | Perron | D04B 1/243 | 2/401 |
| 5,954,564 | A * | 9/1999 | Ganz | A41C 1/003 | 2/73 |
| 5,996,120 | A * | 12/1999 | Balit | A41B 17/00 | 2/243.1 |
| 6,186,970 | B1 * | 2/2001 | Fujii | A41D 13/0015 | 2/22 |
| 6,231,488 | B1 * | 5/2001 | Dicker | A41D 13/0015 | 2/69 |
| 6,728,973 | B1 * | 5/2004 | Webley | A41C 1/003 | 2/400 |
| 6,874,337 | B2 * | 4/2005 | Uno | A41D 1/08 | 2/401 |
| 6,899,591 | B2 * | 5/2005 | Mitchell | A41C 3/0007 | 450/65 |
| 7,143,453 | B2 * | 12/2006 | Duran | A41B 11/003 | 2/409 |
| 7,229,390 | B2 * | 6/2007 | Fujii | A41D 13/0015 | 2/2.16 |
| 7,260,961 | B1 * | 8/2007 | Kennedy | D04B 1/243 | 66/171 |
| 7,509,822 | B2 * | 3/2009 | Ishida | A63B 21/4025 | 2/401 |
| 7,526,929 | B2 * | 5/2009 | Takamoto | A41D 13/0015 | 66/177 |
| 7,546,751 | B2 * | 6/2009 | Lutz | A41B 9/00 | 66/171 |
| 2009/0172858 | A1 * | 7/2009 | Oya | A41C 1/003 | 2/69 |

FOREIGN PATENT DOCUMENTS

| | | | |
|---|---|---|---|
| CN | 101969801 | A | 2/2011 |
| EP | 1967084 | A1 | 9/2008 |
| JP | H11-1853 | A | 1/1999 |
| JP | 2003-138403 | A | 5/2003 |
| JP | 2004-323986 | A | 11/2004 |
| JP | 2005-290625 | A | 10/2005 |
| JP | 2006-316359 | A | 11/2006 |
| JP | 2006-320640 | A | 11/2006 |
| JP | 2007-113125 | A | 5/2007 |
| JP | 2009-052173 | A | 3/2009 |
| JP | 2009-102757 | A | 5/2009 |
| JP | 2010-070876 | A | 4/2010 |
| JP | 2010-084305 | A | 4/2010 |
| WO | 01/13747 | A1 | 3/2001 |
| WO | 2009/091853 | A2 | 7/2009 |

OTHER PUBLICATIONS

Chinese Office Action issued in Chinese Patent Application No. 201180069707.2 on Jul. 7, 2014.

International Search Report issued in corresponding International Patent Application No. PCT/JP2011/057623 dated Jul. 5, 2011.

* cited by examiner

KNITTED FABRIC AND GARMENT USING THE SAME

TECHNICAL FIELD

The present invention relates to a knitted fabric and a garment using the same.

BACKGROUND ART

In some knitted fabrics, portions exhibiting different elongations are formed continuously, depending on their intended use. In recent years, there have been proposed garments (body-shaping garments) that help wearers to achieve beautiful figures by shaping their breasts, waists, hips, etc., and/or to maintain good posture, when they are worn. These garments are designed and produced so that predetermined portions thereof exhibit stronger elongations. As methods for changing the elongation of the predetermined portions of the garment, the following methods have been considered, for example: placing a strip exhibiting a strong tightening force on each portion of a bodice where a higher elongation is desired and fixing the strip thereto; and changing the tightening force of the predetermined portions within the fabric of the bodice (see Patent Document 1, for example). In these garments, in order to provide portions exhibiting different tightening forces, even the same fabric often may be configured so as to include portions having different knit structures, for example. Thus, a step (unevenness in thickness) is liable to be formed at the boundary (section line) between portions with different elongations, and such a step is conspicuous in appearance. Furthermore, at the boundary between knitted fabric regions with different elongations, the knitted fabric region with a higher elongation is liable to be tensioned toward the knitted fabric region with a lower elongation, so that the knitted fabric region with a higher elongation may be damaged partially. Thus, these garments have a problem of insufficient durability. Heretofore, one option to address this problem is to form buffer regions along the boundary line. However, even in the case where buffer regions are formed along the boundary line, the knitted fabric region with a higher elongation is tensioned toward the knitted fabric region with a lower elongation, so that the step (overlap) is formed along the boundary line in the knitted fabric.

CITATION LIST

Patent Document(s)

Patent Document 1: JP 2006-320640 A

SUMMARY OF THE INVENTION

Problem to be Solved by the Invention

In such a garment, it is clear from the appearance that the knitted fabric includes portions with different elongations. That is to say, others can tell at a glance that a person wears a body-shaping garment. Thus, there has been demand from wearers for less self-apparent body-shaping garments. On the other hand, there is a recent trend that some garments conventionally used as innerwear are often used also as outerwear. Thus, even innerwear may be required to be fashionable enough to be "worn in public". However, if section lines between portions with different elongations are conspicuous as described above, consumers tend to think such garments are less fashion conscious.

With the foregoing in mind, it is an object of the present invention to provide a knitted fabric configured so as to make a step formed along the above-described section line smaller, and a garment using the same.

Means for Solving Problem

In order to achieve the above object, the present invention provides a knitted fabric including: a first knitted fabric region; and a second knitted fabric region. The first knitted fabric region and the second knitted fabric region have different elongations from each other. The knitted fabric further includes a buffer region, and the buffer region is provided in at least one of the first knitted fabric region and the second knitted fabric region so as to be in contact with the first knitted fabric region and the second knitted fabric region. The buffer region has an elongation set so that, as the buffer region extends toward either one of the first knitted fabric region and the second knitted fabric region, the difference between the elongation of the buffer region and the elongation of the first knitted fabric region or the second knitted fabric region toward which the buffer region extends is reduced gradually. Between the first knitted fabric region and the second knitted fabric region, there is no boundary line that is substantially parallel to the course direction of the knitted fabric.

With this configuration, in the vicinity of the boundary between the first knitted fabric region and the second knitted fabric region, the buffer region is formed at a portion where inclination of the boundary line with respect to the course direction is small (i.e., where the boundary line is substantially parallel to the course direction). Thus, at the portion where the boundary line is substantially parallel to the course direction, the first knitted fabric region and the second knitted fabric region are not adjacent to each other, so that the boundary line between the two knitted fabric regions is not formed. Thus, it is possible to reduce the step formed at the boundary of the knitted fabric regions, thereby making the step less conspicuous. It is preferable that the first knitted fabric region, the second knitted fabric region, and the buffer region have the same knit structure.

Effects of the Invention

According to the present invention, it is possible to provide a knitted fabric configured so that, even if the elongation thereof is changed locally, the section line between portions with different elongations is inconspicuous. Also, by using the knitted fabric according to the present invention, it is possible to provide a garment that achieves excellent fashionability while maintaining the effect of helping a wearer to achieve a beautiful figure and/or to maintain good posture, for example.

MODE FOR CARRYING OUT THE INVENTION

In recent years, there has been proposed a garment with a body-shaping function, that achieves a desired shaping function by changing the elongation of a knitted fabric locally, thereby applying the so-called constricting force for constricting a wearer's body. One method for realizing such a body-shaping function is to make predetermined portions of the knitted fabric less stretchable. However, when the elongation of the knitted fabric is reduced locally so as to provide less-stretchable portions, there arises a problem in that, at the boundary between a portion with the reduced elongation and a portion in which the elongation is not reduced, the portion with a knit structure exhibiting a higher elongation is tensioned toward the portion with a knit structure exhibiting with a lower elongation, which causes a step to be formed.

With the foregoing in mind, the inventors of the present invention diligently researched how the above-described step can be reduced. As a result, they discovered that, at the above-described boundary, a larger step is liable to be formed in a portion having a small inclination with respect to the course direction of a knitted fabric (a portion substantially parallel to the course direction) than in a portion having a large inclination with respect to the same, and advanced the research focusing on this point. Then, the inventors of the present invention found out that, by providing buffer regions around a portion where the inclination of the boundary line with respect to the course direction is small, formation of the step is suppressed and the overlap of the knitted fabric is reduced. As a result, the inventors of the present invention found out that, with this configuration, a section line formed at the boundary between portions with different elongations in a knitted fabric can be made more inconspicuous, so that even a garment having a body-shaping function can be made less obvious that it is a body-shaping garment from its appearance.

In the present invention, the "boundary line that is substantially parallel" preferably is a boundary line that forms an angle in the range from ±0° to 15°, more preferably ±0° to 10°, with the course direction.

The knitted fabric according to the present invention will be described below with reference to illustrative examples. It is to be noted, however, that the present invention is by no means limited to or restricted by the following examples.

(First Embodiment)

Figure 1:
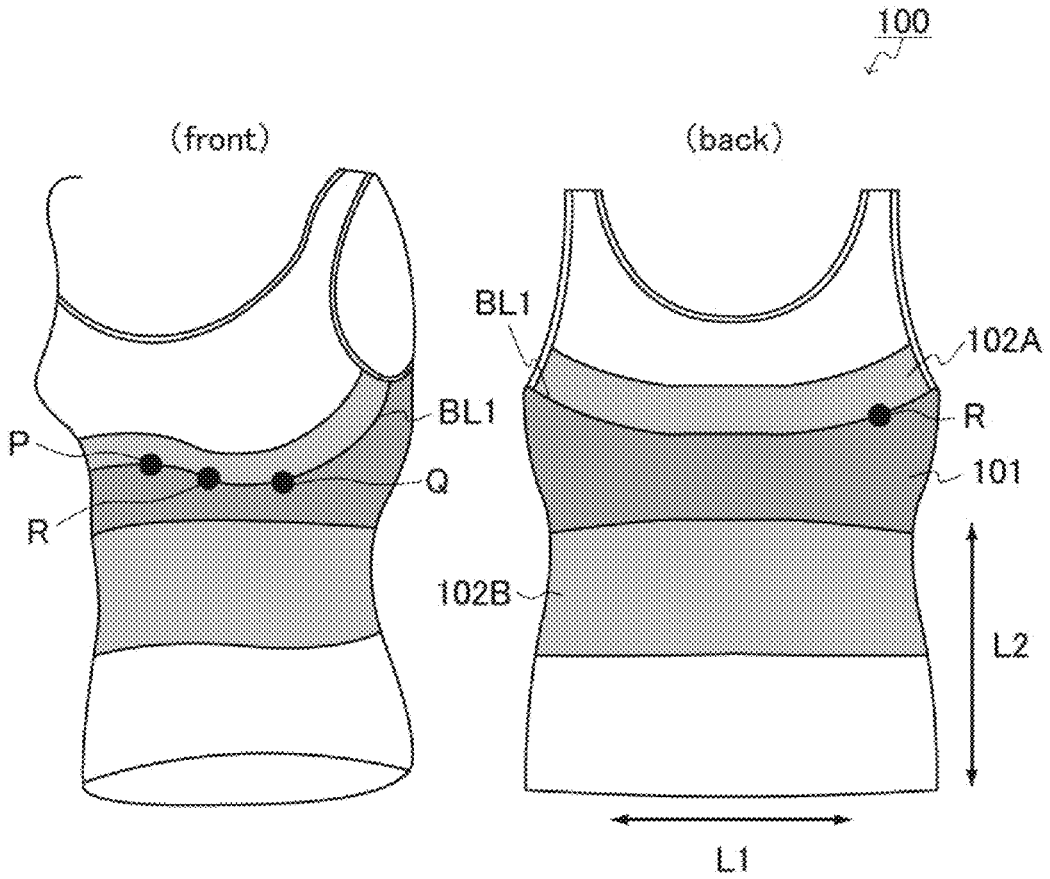
FIG. 1 is a perspective view showing, as an example of a garment using the knitted fabric of the present invention, a camisole according to the first embodiment.

FIG. 1 shows an example of an embodiment of the garment using the knitted fabric of the present invention. FIG. 1 shows a camisole 100 having a body-shaping effect. The camisole 100 of the present embodiment is configured so as to exhibit a predetermined body-shaping effect by adjusting the elongation of the same knit structure to three levels, namely, high, medium, and low. In FIG. 1, the arrow L1 indicates the course direction of the knitted fabric, and the arrow L2 indicates the wale direction of the knitted fabric.

In FIG. 1, a portion with a low elongation is a shaping region (first knitted fabric region) 101, and portions with a medium elongation are shaping regions (second knitted fabric regions) 102A and 102B. The shaping region 101 is set so as to exhibit the lowest elongation, and is provided so as to be located around a wearer's waist to cover the wearer's under bust part when the camisole is worn. The shaping region 101 thus constricts the under bust part, so that a breast-enhancing effect can be obtained.

The shaping regions 102A and 102B are set so as to exhibit a medium elongation, and provided above and below the shaping region 101, respectively. The shaping region 102A is provided so as to cover lower parts of the wearer's breasts. Thus, the shaping region 102A can improve the breast-enhancing effect. The shaping region 102B is provided so as to cover the wearer's abdomen, so that it constricts a region around the wearer's abdomen. Thus, it is possible to obtain an effect of making a protruding abdomen less conspicuous.

The reference numeral BL1 indicates the boundary line between the shaping region 101 and the shaping region 102A. The reference numerals P, Q, and R indicate the following three points on the boundary BL1, respectively: a front center point; the lowest point on the lower contour of the breast; and a point located between the lower contour of the breast and the front center.

Figure 2:
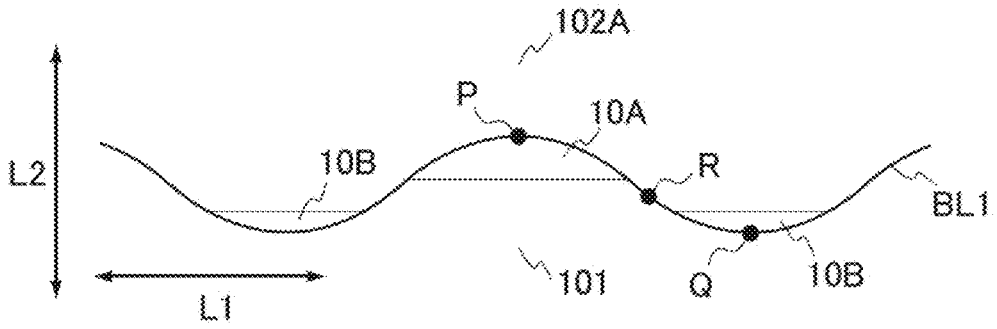
FIG. 2 is a schematic view showing an example of the structure of buffer regions formed around the boundary BL1 between knitted fabrics with different elongations in the camisole according to the first embodiment of the present invention.

FIG. 2 schematically shows the structure of buffer regions around the boundary BL1. In FIG. 2, illustration of the structure of a buffer region formed around the point R located between the lower contour of the breast and the front center is omitted. As shown in FIG. 2, the boundary BL1 is curved in a letter "W" shape so as to conform to the curves of lower parts of the right and left breasts. The boundary BL1 is formed in such a manner that the curvature of a curved portion around the lowest point Q of the lower contour of the breast is greater than the curvature of a curved portion around the front center point P. In the front center part where the boundary BL1 is curved so as to protrude toward the shaping region 102A, a buffer region 10A is formed in an arc shape at a portion where the inclination of the boundary BL1 with respect to the course direction L1 is small (i.e., the bottom portion).

On the other hand, in each portion where the boundary BL1 is curved so as to protrude toward the shaping region 101, a buffer region 10B is formed in an arc shape at a portion where the inclination of the boundary BL1 with respect to the course direction L1 is small (i.e., the bottom portion). The present embodiment is directed to an example where the buffer regions 10A and 10B are provided. However, for example, it is also possible to employ a configuration where only the buffer regions 10B are provided and the buffer region 10A is not provided, if such is required in light of the design. As described above, the knitted fabric 100 may be configured so that the buffer regions of the present invention are provided only in some of the portions where the step is liable to be formed.

Figure 3:
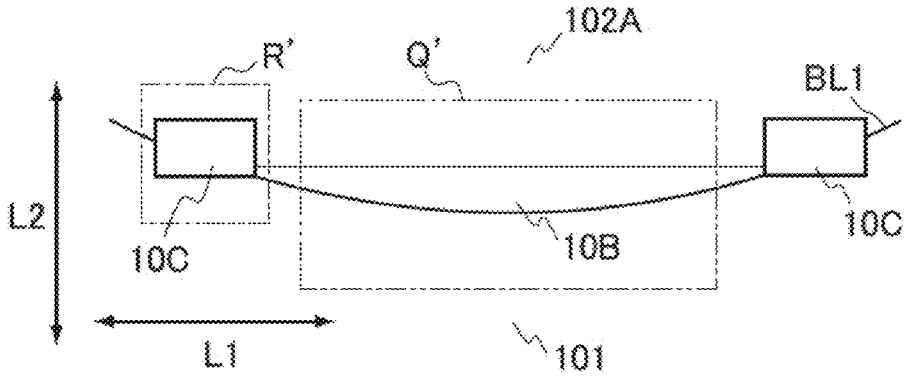
FIG. 3 is a schematic view showing the structure of buffer regions around the buffer region 10B shown in FIG. 2.

FIG. 3 is a schematic view showing the structure of buffer regions in a region R' around the point R located between the lower contour of the breast and the front center and in a region Q' around the lowest point Q of the lower contour of the breast. In a portion where the boundary BL1 is curved so as to protrude toward the shaping region 101, a buffer region 10B is formed in an arc shape at a portion where the inclination of the boundary BL1 with respect to the course direction L1 is small (i.e., the bottom portion). A buffer region 10C is provided in a region that is located around the point R located between the lower contour of the breast and the front center, where the inclination of the boundary BL1 with respect to the course direction L1 is relatively small. A step may be formed even at a portion where the inclination is gentle. Thus, the buffer region 10C is provided as described above so as to prevent the formation of a large step. Also, as shown in FIG. 3, the buffer region 10C may be provided astride the shaping region 101 and the shaping region 102A. By providing the buffer region so as to extend across the boundary BL1 as described above, the boundary is prevented from being formed in parallel to the course direction. With this configuration, the step at the boundary can be made more inconspicuous. Although the present embodiment is directed to an example where the buffer regions 10B are formed in an arc shape, the present invention is not limited thereto.

Each buffer region has an elongation set so that, as the buffer region extends toward either one of the boundary with the first knitted fabric region and the second knitted fabric region, the difference between the elongation of the buffer region and the elongation of the first knitted fabric region or the second knitted fabric region toward which the buffer region extends is reduced gradually. Alternatively, the buffer region may have a single elongation that is a value between the elongation of the first knitted fabric region and the elongation of the second knitted fabric region. The buffer region can be formed specifically by adjusting the density thereof in such a manner that it gradually changes from the density of the shaping region 101 to the density of the shaping region 102A, for example. In the wale direction L2, the buffer region 10A is formed so as to extend from the boundary (section line) BL1 toward the shaping region 101 having the lower elongation. The density of the buffer region 10A is adjusted so that the elongation of the buffer region 10A increases gradually toward the section line BL1. In the wale direction L2, the buffer region 10B is formed so as to extend from the boundary (section line) BL1 toward the shaping region 102A having the higher elongation. The density of the buffer region 10B is adjusted so that the elongation of the buffer region 10B starts to increase gradually from the section line BL1. Regarding the knit structure in the course direction L1 of each buffer region, the density may be set so as to be uniform. By providing the buffer regions whose elongation is changed stepwise so as to even out the difference in elongation between the knitted fabrics with different elongations as described above, the section line between the knitted fabrics with different elongations can be made more inconspicuous. The camisole of the present embodiment can be produced easily by weft knitting using a circular knitting machine or the like, for example. However, the method for producing the camisole of the present embodiment is not limited thereto, and it also can be produced by warp knitting such as raschel knitting or double raschel knitting.

In the present embodiment, between the shaping region (first knitted fabric region) 101 and the shaping region (second knitted fabric region) 102A, there is no boundary line that is substantially parallel to the course direction of the knitted fabric. The boundary lines formed by direct contact between the shaping region 101 and the shaping region 102A are only those that are not substantially parallel to the course direction of the knitted fabric, like the one in a portion in the vicinity of the point R in FIG. 2. In other portions (portions that are substantially parallel to the course direction), the buffer regions 10A and 10B are formed between the shaping region 101 and the shaping region 102A, thereby allowing the step at the boundary between these regions to be made inconspicuous.

The camisole 100 of the present embodiment is knitted so that the portion for covering the wearer's breasts exhibits a high elongation. Accordingly, the camisole 100 does not squash the wearer's breasts when it is worn, thus exhibiting a fine breast-shaping properties. Furthermore, with the configuration where the elongation of the under bust part is set to be low, the verge's lines can be prevented from being not well defined. Still further, with the configuration where the elongation in the vicinity of the waistline is set to be medium, the camisole 100 allows the wearer to maintain a fine figure without constricting the wearer's abdomen too much. Also, by providing the buffer regions on the section line, the step can be made more inconspicuous in appearance, and besides, the force pressing the wearer's body when it is worn can shift between strong and weak in a stepwise manner. Thus, it is also possible to solve the problem caused by partial constriction, such that the section parts leave patterns on the wearer's skin. Although three levels of elongation are set in the present example, the number of levels of elongation may be two, or may be more than three. As described above, according to the present embodiment, it is possible to obtain a garment that exhibits an effect of controlling the wearer's figure and does not reveal easily from it appearance that the elongation thereof is changed in a plurality of levels. Some consumers may have feelings of resistance to wear body-controlling underwear owing to its appearance, although they are attracted to wear a garment having a body-controlling effect of the body-controlling underwear. Those consumers can wear the camisole of the present embodiment without reluctance. In the garment of the present embodiment, the knitted fabric according to the present invention may be used either entirely or partially. For example, one possible configuration is such that a portion in which the step should be made inconspicuous is formed of the knitted fabric of the present invention, whereas a portion in which the step should be left to accent the design is formed of a knitted fabric other than the knitted fabric of the present invention.

(Modified Example A1)

Figure 4A:
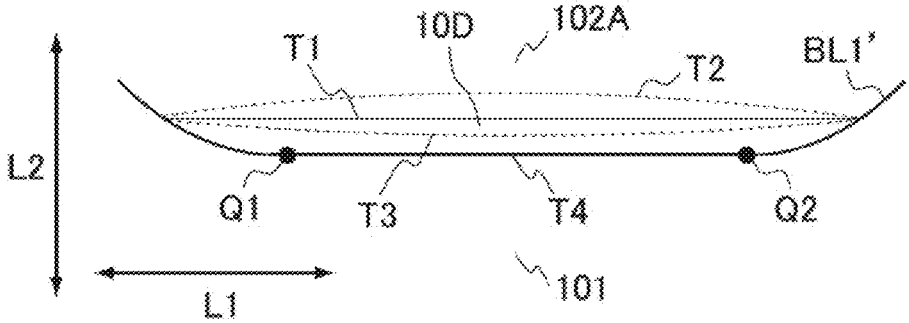
FIGS. 4A, 4B, and 4C are schematic views respectively showing modified examples A1, A2, and A3 of the structure of the buffer regions in the first embodiment.

FIG. 4A shows the modified example A1 of the first embodiment. Although the boundary BL1 is curved upward around the front center in the first embodiment, it is also possible to provide a boundary BL1' that is not curved upward around the front center, for example, as shown in FIG. 4A. In this case, a buffer region 10D may have a shape closely analogous to a trapezoid. The reference numerals Q1 and Q2 indicate the positions of the lowest points on the lower contours of the right and left breasts on the boundary BL1, respectively.

The reference numeral T1 indicates the upper edge of the buffer region 10D. The upper edge of the buffer region 10D may be curved gently toward the shaping region 102A so as to be non-parallel to the course direction L1 of the knitted fabric, like an upper edge T2 indicated with a dashed line. When the upper edge of the buffer region 10D is curved in the above-described manner, the amount of a portion parallel to the course direction L1 can be reduced as compared with that in the upper edge T1, so that it is possible to further reduce the step between the upper edge T2 and the shaping region 102A. Also, the upper edge may be curved toward the shaping region 101, like an upper edge T3 in FIG. 4A. Moreover, by curving the lower edge T4 of the buffer region toward the shaping region 102A or toward the shaping region 101 instead of curving the upper edge of the buffer region, it is also possible to obtain the same effect.

When the width of the buffer region (the length of the buffer region in the course direction) is set to be large as in the present modified example, it is possible to reduce the step around the upper edge T1 or the lower edge T4 by curving the upper edge T1 or the lower edge T4.

(Modified Example A2)

Figure 4B:
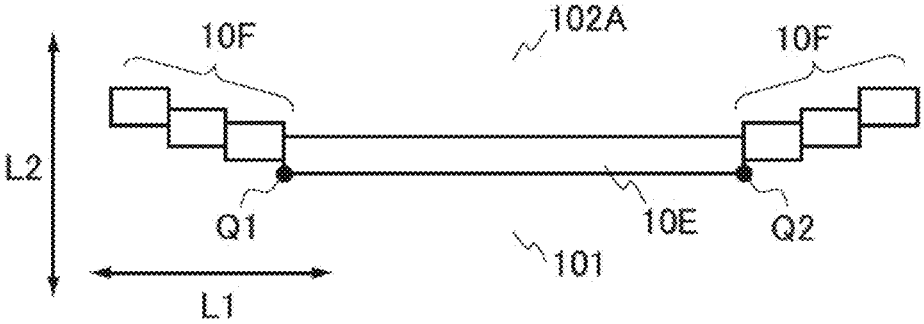

FIG. 4B shows the modified example A2 of the first embodiment. In the modified example A2, a rectangular buffer region 10E is provided at the bottom portion, and at both ends of the buffer region 10E, buffer regions 10F are provided instead of the boundary BL1. In this case, the same effect as in the first embodiment also can be obtained.

(Modified Example A3)

Figure 4C:
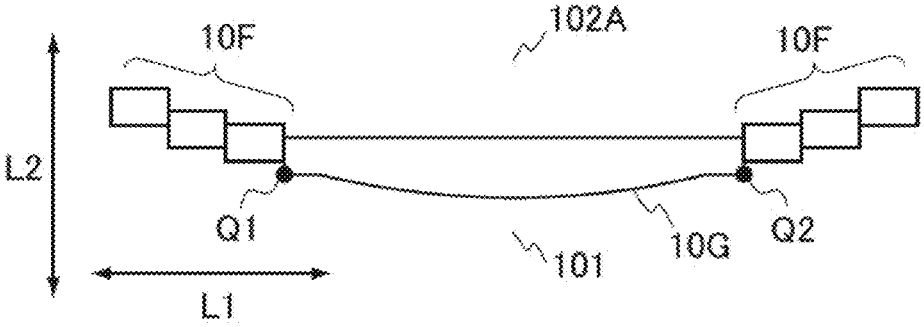

FIG. 4C shows the modified example A3 of the first embodiment. The modified example A3 is an example where a buffer region 10G is formed by curving part of the lower edge of the buffer region 10E shown in the modified example A2 downward. Other configurations are the same as those in the modified example A2.

(Modified Example B)

Figure 5A:
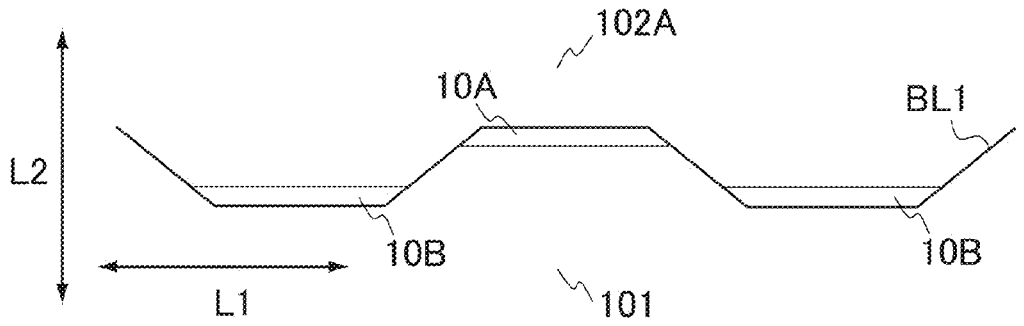
FIGS. 5A and 5B are schematic views showing other modified examples B of the structure of the buffer regions in the first embodiment.
Figure 5B:
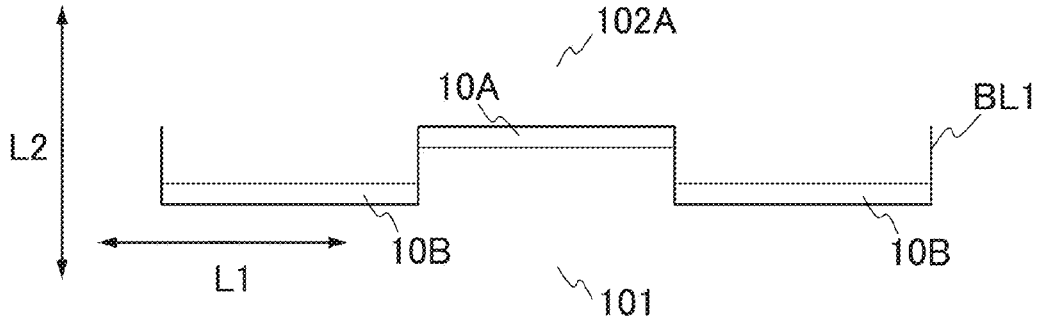

FIG. 5 shows other modified examples of the first embodiment. Although the boundary BL1 has a wave-like curved shape in the first embodiment, the boundary BL1 may be formed in a trapezoidal wave shape as shown in FIG. 5A, or in a rectangular wave shape as shown in FIG. 5B.

In these cases, buffer regions 10A and 10B may be formed in appropriate shapes depending on the shape and specifications of the boundary BL1.

(Second Embodiment)

Figure 6A:
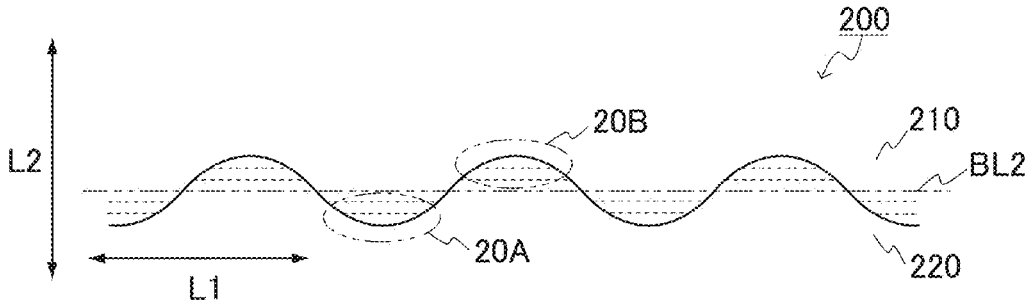
FIGS. 6A, 6B, and 6C are schematic views showing the structure of a portion around the boundary between a first knitted fabric and a second knitted fabric in a knitted fabric of the second embodiment.

The schematic views of FIG. 6 each show an example of the structure of a portion around the boundary between a first knitted fabric region and a second knitted fabric region in the knitted fabric according to the present invention. FIG. 6 shows a knitted fabric 200 configured so that the boundary BL2 (the section line, indicated with a chain double-dashed line in FIG. 6) between the first knitted fabric region 210 and the second knitted fabric region 220 having different elongations from each other is parallel to the course direction. FIG. 6 shows the knitted fabric in which the first knitted fabric region 210 provided above the section line BL2 has a high elongation (density: high), and the second knitted fabric region 220 provided below the section line BL2 has a low elongation (density: low). In FIG. 6A, a plurality of buffer regions are formed continuously along the section line BL2.

Buffer regions 20A protruding toward the second knitted fabric region 220 and buffer regions 20B protruding toward the first knitted fabric region 210 are formed alternately, with the buffer regions being curved in the wale direction of the knitted fabric 200 to provide a wave-like shape. In the present embodiment, by providing a plurality of buffer regions alternately in the first knitted fabric region 210 and in the second knitted fabric region 220, the boundary is prevented from being formed in parallel to the course direction. With this configuration, the step at the boundary can be made more inconspicuous.

The densities of the buffer region 20A and the buffer region 20B are adjusted to change gradually so that, for example: as the buffer region 20A extends toward the boundary with the first knitted fabric region 210, the difference between the elongation thereof and the elongation of the first knitted fabric region 210 becomes smaller; and as the buffer region 20B extends toward the boundary with the second knitted fabric region 220, the difference between the elongation thereof and the elongation of the second knitted fabric region 220 becomes smaller. In the wale direction L2, the buffer region 20A is formed so as to extend from the section line BL2 toward the second knitted fabric region 220 having the lower elongation. The density of the buffer region 20A is adjusted so that the elongation of the buffer region 20A increases gradually toward the section line BL2. In the wale L2 direction, the buffer region 20B is formed so as to extend from the section line BL2 toward the first knitted fabric region 210 having the higher elongation. The density of the buffer region 20B is adjusted so that the elongation of the buffer region 20B starts to increase gradually from the section line BL2. Regarding the knit structure in the course direction L1 of each buffer region, the density is set so as to be uniform, for example. By providing the buffer regions in the above-described manner, the section line between the portions with different elongations can be made more inconspicuous.

Figure 6B:
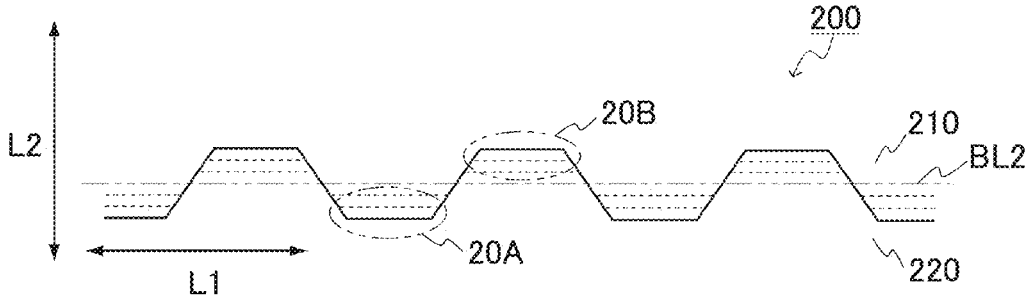
Figure 6C:
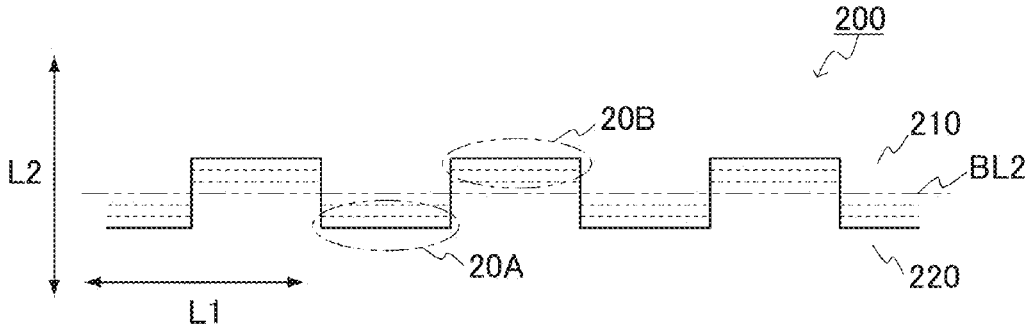

The buffer region may be formed in a wave-like shape as shown in FIG. 6A, a trapezoidal shape as shown in FIG. 6B, or a rectangular shape as shown in FIG. 6C, for example. Each buffer region preferably is formed so as not to have a shape including an acute angle (e.g., triangular) from the viewpoint of making the section line less conspicuous. Also, it is possible to use wave-like buffer regions, trapezoidal buffer regions, and rectangular buffer regions in combination. It is not always necessary to form the buffer regions alternately as described above, and for example, only the buffer regions 20A or only the buffer regions 20B may be provided. Depending on the length of the section line, a single buffer region may be provided. By using buffer regions with different shapes and/or sizes in combination, the above-described effect of the present invention also can be obtained even when the knitted fabric has complex section lines.

The elongation of the buffer region preferably is changed by adjusting the density to about 3 to 16 levels. In the buffer region according to the present embodiment, for example, it is preferable to achieve the change from a low elongation to a high elongation by conducting precise density adjustment of about 10 levels with one level being 0.05 mm, because this allows the section line to be inconspicuous in appearance. When the buffer region is trapezoidal or rectangular, the number of wales constituting the upper side of the trapezoid and the number of wales constituting the width of the rectangular each may be in the range from about 30 to about 50, and can be set to 40, for example.

(Third Embodiment)

FIG. 7 illustrates the structures of a buffer region(s) in a knitted fabric of the present embodiment. Although the respective structures are described as modified examples of the buffer region 10B shown in FIG. 2, the following modified examples are not only applicable to the modification of the buffer region 10B, but also are applicable to the modification of any other buffer region.

Figure 7A:
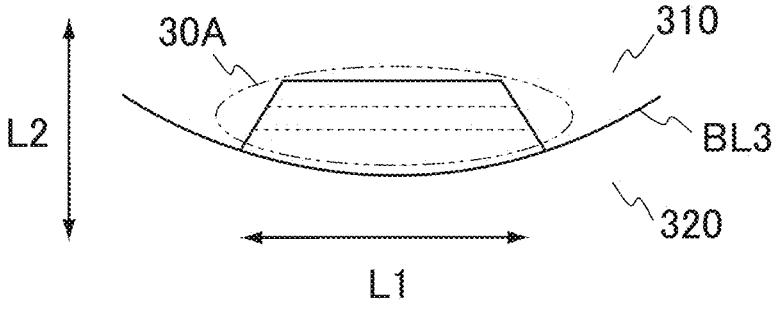
FIGS. 7A, 7B, and 7C are schematic views showing the structures of a buffer region(s) in a knitted fabric of the third embodiment.

In the case where the knitted fabric includes a boundary BL3 having a large curvature, a trapezoidal buffer region 30A as shown in FIG. 7A is formed in a first knitted fabric region 310. As in the present modified example, the buffer region may be formed so as to include part of a region in the vicinity of the bottom of the curved portion.

Figure 7B:
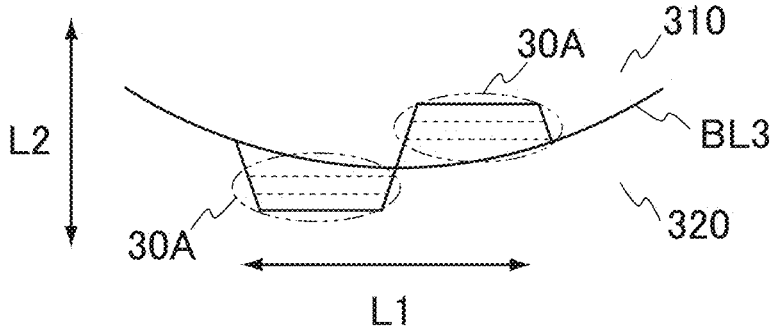
Figure 7C:
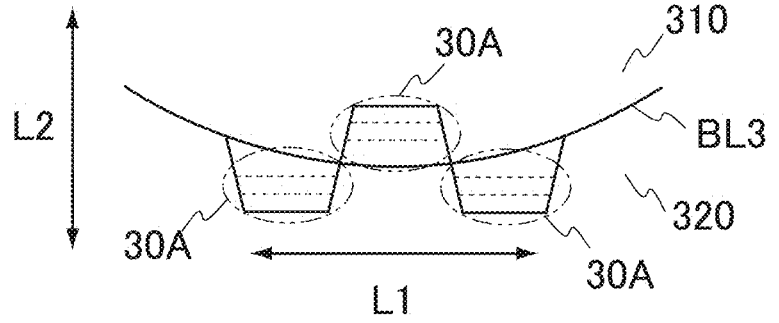

Also, by providing trapezoidal buffer regions 30A alternately in the first knitted fabric region 310 and in a second knitted fabric region 320, it is possible to reduce the overlap of the knitted fabric regions on the boundary line. FIG. 7B shows an example where one buffer region 30A is formed in each of the first knitted fabric region 310 and the second knitted fabric region 320. However, as shown in FIG. 7C, the knitted fabric may be configured so that one buffer region 30A is formed in the first knitted fabric region 310 and two buffer regions 30A are formed in the second knitted fabric region 320, for example.

(Fourth Embodiment)

Figure 8:
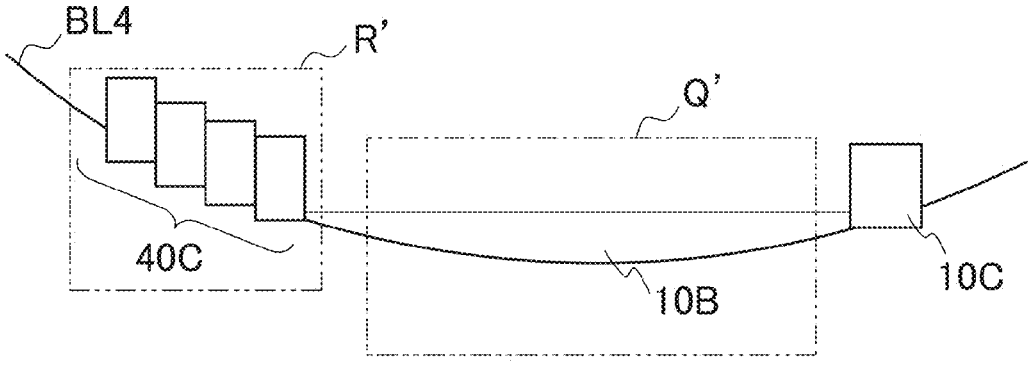
FIG. 8 is a schematic view showing the structure of buffer regions in a knitted fabric of the fourth embodiment.

FIG. 8 illustrates the structure of buffer regions in the present embodiment. Although the structure is described as a modified example of the buffer region 10C shown in FIG. 3, the following modified example is not only applicable to the modification of the buffer region 10C but also is applicable to the modification of any other buffer region.

In the case where a boundary BL4 includes a straight inclined portion that extends a long distance as shown in FIG. 8, the distance of a portion of a buffer region formed substantially parallel to the course direction becomes long, so that the section part between portions with different elongations may be seen easily at the substantially parallel portion of the buffer region. In such a case, a plurality of buffer regions may be provided in a stair-like form. In a portion where the boundary between the first knitted fabric region and the second knitted fabric region inclines with respect to the course direction, it is possible to reduce the step by forming the buffer regions 40C in a stair-like form. The buffer regions shown in FIG. 8 can be applied favorably to a region extending from around the reference numeral Q to around the reference numeral R in the front bodice of the camisole 100 shown in FIG. 1, for example. A buffer region 10B can be provided in a region Q' around the reference numeral Q, and the buffer regions 40C can be provided in a region R' around the reference numeral R. Because a step may be formed at a portion where gentle inclination extends a long distance, it is preferable to provide the buffer regions 40C in a stair-like form from the viewpoint of reducing the step.

(Fifth Embodiment)

Figure 9A:
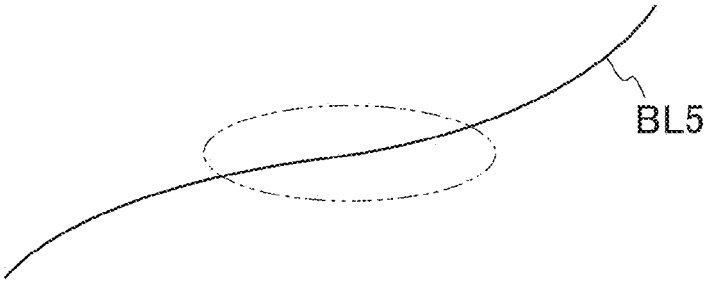
FIGS. 9A and 9B are schematic views showing the structure of buffer regions in a knitted fabric of the fifth embodiment.
Figure 9B:
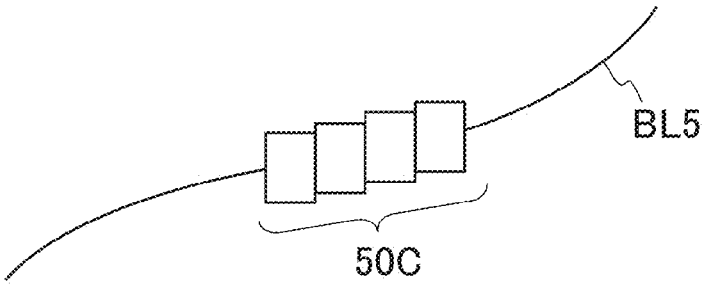

FIG. 9 illustrates the structure of buffer regions in the present embodiment. When a boundary BL5 is formed in such a manner that the inclination thereof with respect to the course direction is changed continuously as shown in FIG. 9A, instead of being curved in a letter U shape, it is effective to arrange the buffer regions of the present invention at a portion where the inclination of the boundary BL5 with respect to the course direction is smaller than those in other portions. As shown in FIG. 9B, it is preferable to provide buffer regions 50C in a stair-like form in such a portion.

(Sixth Embodiment)

Figure 10:
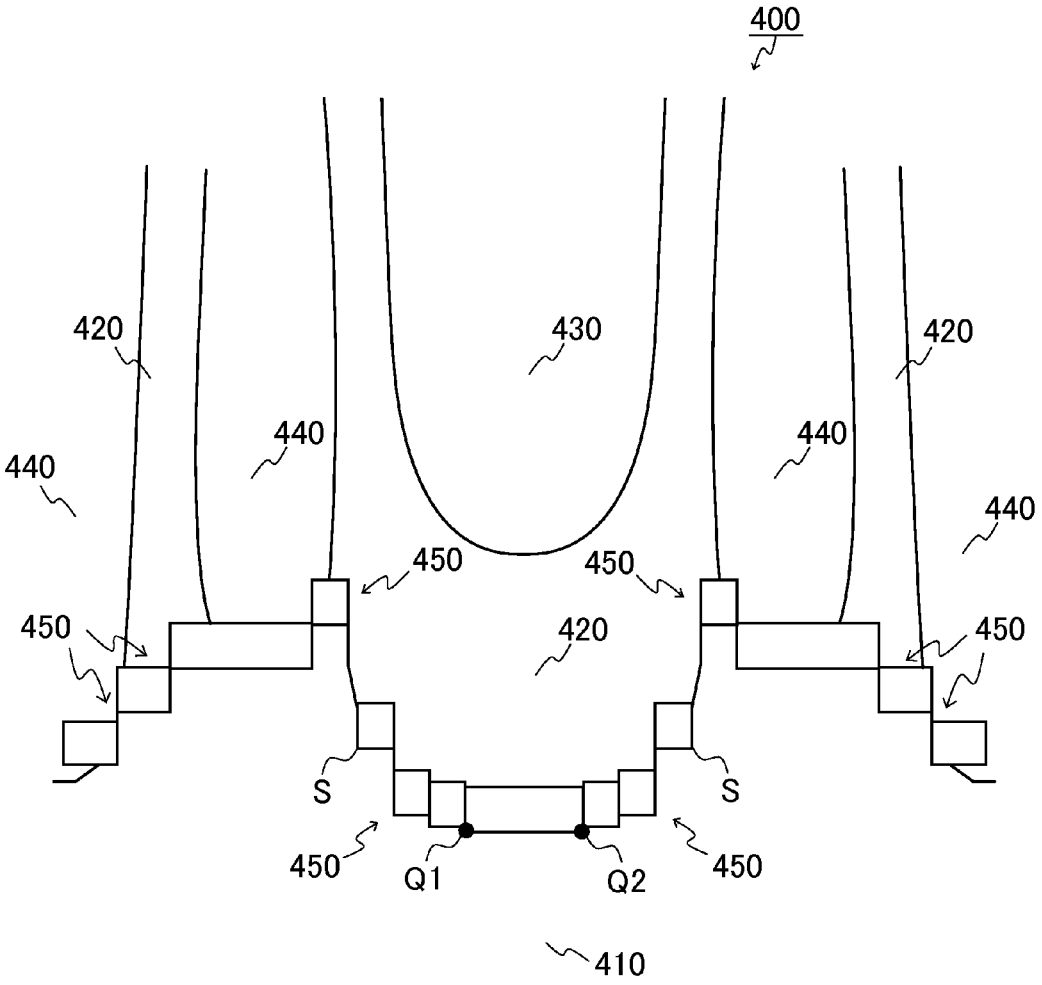
FIG. 10 is a schematic view showing the structure of buffer regions in a knitted fabric of the sixth embodiment.

FIG. 10 illustrates the structure of buffer regions in the present embodiment. A knitted fabric 400 shown in FIG. 10 is part of a knitted fabric constituting a camisole or the like. The knitted fabric 400 includes: a shaping region (first knitted fabric region) 410, shaping regions (second knitted fabric regions) 420, and excess fabric regions 430 and 440. The shaping region 410 is a portion for covering the main body of a front bodice that extends below lower parts of a wearer's breasts. The shaping regions 420 are portions for covering a region extending from the lower parts of the wearer's breasts to a portion around the wearer's neck. By cutting away the right and left excess fabric regions 440, armholes are formed in the knitted fabric 400. By cutting away the excess fabric region 430 in the middle, an opening for insertion of the wearer's head is formed. The shaping region 410 is formed so as to exhibit a lower elongation than the other three kinds of regions, namely, the excess fabric region 430, the shaping regions 420, and the excess fabric regions 440. The excess fabric region 430 is formed so as to exhibit a lower elongation than the shaping region 410. The shaping regions 420 are formed so as to exhibit a lower elongation than the excess fabric region 430. The elongation of the excess fabric regions 440 is set to be comparable with the elongation of the shaping region 420. The buffer regions 450 and the buffer regions S are formed between the shaping regions 420 and the shaping region 410 and between the excess fabric regions 440 and the shaping region 410, respectively. With this configuration, the steps formed at the boundaries between portions where the difference in elongation is large are reduced. In FIG. 10, the reference numerals Q1 and Q2 indicate the positions of the lowest points on the verge's lines of right and left breasts, respectively.

In the present embodiment, the structure of the buffer regions in the vicinity of an under bust region on the front center side is similar to that of the buffer regions shown in FIG. 4B. At portions where the boundary line of the knitted fabric regions is not substantially parallel to the course direction, no buffer region is provided, and the knitted fabric regions are in contact with each other. As in the buffer regions S, the boundary line may incline in appearance, and the inclined portion is not curved but may be seen as a curve by knitting stitches in a stair-like form. In the case where this stair-like portion includes a portion(s) parallel to the course direction, it is possible to make a step formed at this portion more inconspicuous by providing a buffer region(s) in the portion. When buffer regions are provided only in the vicinity of the under bust region, although the step (overlap) of the knitted fabrics is suppressed in the vicinity of this region, the step may be conspicuous in regions adjacent to this region. In such a case, it is effective to provide buffer regions in a stair-like form with a buffer region being apart from other buffer regions, like the buffer region S.

Portions of the knitted fabric 400 at the right and left ends in FIG. 10 are each a portion for covering a region extending from the underarm to the back of a wearer. In the portion extending from the underarm to the back, buffer regions are provided in a stair-like form so as to conform to the inclination of the boundary line in the knitted fabric. By configuring the knitted fabric in the above-described manner, it is possible to obtain the camisole 100 shown in FIG. 1, for example.

The present invention has been described above with reference to specific examples of its embodiment, namely, a camisole and a knitted fabric constituting a camisole. It is to be noted, however, the garment using the knitted fabric according to the present invention is not limited to those described in the specific examples, and can be embodied in various forms. For example, the present invention is applicable not only to the camisole described in the above embodiments, but also to other foundation garments such as bodysuits and girdles. The present invention also is applicable to brassiere-provided camisoles, tops of separate-type swimsuits, leotards, other bottom garments, and other various garments.

INDUSTRIAL APPLICABILITY

The garment using the knitted fabric according to the present invention can be embodied in various forms. For example, the present invention is applicable not only to the foundation garments described in the above embodiments but also to various garments such as sportswear and outerwear. Also, the knitted fabric according to the present invention is applicable not only to garments but also to any applications that require changing the elongation.

EXPLANATION OF REFERENCE NUMERALS

100: camisole (garment)
101, 410: shaping region (first knitted fabric region)
102A, 102B, 420: shaping region (second knitted fabric region)
200, 400: knitted fabric
210, 310: first knitted fabric region
220, 320: second knitted fabric region
430, 440: excess fabric region
10A, 10B, 10C, 10D, 10E, 10F, 10G, 20A, 20B, 30A, 40C, 50C, 450, S: buffer region
L1: course direction
L2: wale direction

The invention claimed is:

1. A knitted fabric comprising:
a first knitted fabric region; and
a second knitted fabric region,
the first knitted fabric region and the second knitted fabric region having different elongations from each other, wherein
the knitted fabric further comprises a buffer region formed by adjusting a density of the buffer region,
the buffer region is provided in at least one of the first knitted fabric region and the second knitted fabric region so as to be in contact with the first knitted fabric region and the second knitted fabric region,
the buffer region has an elongation set so that, as the buffer region extends toward either one of the first knitted fabric region and the second knitted fabric region, the difference between the elongation of the buffer region and the elongation of the first knitted fabric region or the second knitted fabric region toward which the buffer region extends is reduced gradually, and
between the first knitted fabric region and the second knitted fabric region, there is no boundary line that is substantially parallel to the course direction of the knitted fabric.

2. The knitted fabric according to claim 1, wherein between the first knitted fabric region and the second knitted fabric region, there is no boundary line that forms an angle in the range from ±0° to 15° with the course direction of the knitted fabric.

3. The knitted fabric according to claim 1, wherein between the first knitted fabric region and the second knitted fabric region, there is no boundary line that forms an angle in the range from ±0° to 10° with the course direction of the knitted fabric.

4. The knitted fabric according to claim 1, wherein the buffer region is provided astride the first knitted fabric region and the second knitted fabric region.

5. The knitted fabric according to claim 1, wherein there are a plurality of buffer regions, and the buffer regions are formed continuously.

6. The knitted fabric according to claim 1, wherein there are a plurality of buffer regions, and the buffer regions are formed alternately in the first knitted fabric region and in the second knitted fabric region.

7. The knitted fabric according to claim 1, wherein there are a plurality of buffer regions, and the buffer regions are provided in a stepwise arrangement.

8. The knitted fabric according to claim 1, wherein a perimeter of the buffer region is not parallel to the course direction.

9. The knitted fabric according to claim 1, wherein the perimeter of the buffer region is curved.

10. The knitted fabric according to claim 1, wherein the first knitted fabric region, the second knitted fabric region, and the buffer region have the same knit structure.

11. A garment comprising the knitted fabric according to claim 1.

12. The knitted fabric according to claim 1, wherein between the first knitted fabric region and the second knitted fabric region, there is no boundary line that forms an angle in the range from ±0° to 15° with the course direction of the knitted fabric, and
the buffer region is provided astride the first knitted fabric region and the second knitted fabric region.

13. The knitted fabric according to claim 1, wherein between the first knitted fabric region and the second knitted fabric region, there is no boundary line that forms an angle in the range from ±0° to 15° with the course direction of the knitted fabric, and
there are a plurality of buffer regions, and the buffer regions are formed alternately in the first knitted fabric region and in the second knitted fabric region.

14. The knitted fabric according to claim 1, wherein between the first knitted fabric region and the second knitted fabric region, there is no boundary line that forms an angle in the range from ±0° to 15° with the course direction of the knitted fabric, and
a perimeter of the buffer region is not parallel to the course direction.

15. The knitted fabric according to claim 1, wherein between the first knitted fabric region and the second knitted fabric region, there is no boundary line that forms an angle in the range from ±0° to 10° with the course direction of the knitted fabric, and
the buffer region is provided astride the first knitted fabric region and the second knitted fabric region.

16. The knitted fabric according to claim 1, wherein between the first knitted fabric region and the second knitted fabric region, there is no boundary line that forms an angle in the range from ±0° to 10° with the course direction of the knitted fabric, and
there are a plurality of buffer regions, and the buffer regions are formed alternately in the first knitted fabric region and in the second knitted fabric region.

17. The knitted fabric according to claim 1, wherein between the first knitted fabric region and the second knitted fabric region, there is no boundary line that forms an angle in the range from ±0° to 10° with the course direction of the knitted fabric, and
a perimeter of the buffer region is not parallel to the course direction.

18. The knitted fabric according to claim 1, wherein between the first knitted fabric region and the second knitted fabric region, there is no boundary line that forms an angle in the range from ±0° to 15° with the course direction of the knitted fabric, and
the first knitted fabric region, the second knitted fabric region, and the buffer region have the same knit structure.

19. The knitted fabric according to claim 1, wherein between the first knitted fabric region and the second knitted fabric region, there is no boundary line that forms an angle in the range from ±0° to 10° with the course direction of the knitted fabric, and the first knitted fabric region, the second knitted fabric region, and the buffer region have the same knit structure.

* * * * *